United States Patent [19]

Calabrese

[11] 4,303,235

[45] Dec. 1, 1981

[54] PAPER CASSETTE

[76] Inventor: Richard A. Calabrese, Saw Mill Rd., Newtown, Conn. 06470

[21] Appl. No.: 179,302

[22] Filed: Aug. 18, 1980

[51] Int. Cl.[3] ..... B65H 3/54

[52] U.S. Cl. ..... 271/162; 271/9; 271/22; 271/170

[58] Field of Search ..... 271/145, 162, 164, 170, 271/171, 22, 24, 9

[56] References Cited

U.S. PATENT DOCUMENTS

| | | | |
|---|---|---|---|
| 3,659,837 | 5/1972 | Umahashi | 271/164 X |
| 3,977,666 | 8/1976 | Suzuki | 271/171 X |
| 4,108,427 | 8/1978 | Komori | 271/162 X |
| 4,131,274 | 12/1978 | Sue | 271/170 X |

*Primary Examiner*—Richard A. Schacher

*Attorney, Agent, or Firm*—Lawrence E. Sklar; William D. Soltow, Jr.; Martin D. Wittstein

[57] ABSTRACT

A paper cassette for storing two different lengths of paper sheets. The cassette comprises a rear panel, a pair of side panels extending forward from the rear panel, a front panel operatively connected to the pair of side panels, a bottom panel extending between the bottom of the side panels from the bottom of the rear panel about three quarters of the distance toward the bottom of the front panel, and a top panel extending between the top of the side panels from the top of the rear panel about three quarters of the distance toward the top of the front panel. Additionally, the cassette comprises a first pair of free floating corner separators situated at the top of the corners defined by the front and side panels, a second pair of free floating corner separators situated at the bottom of the corners defined by the front and side panels, a flexible separator panel extending from the rear panel substantially the entire length of the cassette but spaced from said front panel and substantially bifurcating the cassette into a top portion and a bottom portion, the top portion accommodating the shorter length paper and the bottom portion accommodating the longer length paper, and a partition extending between the side panels across the top portion of the cassette, the partition being situated a fixed distance from the rear panel to accommodate the shorter length paper.

4 Claims, 5 Drawing Figures

PAPER CASSETTE

BACKGROUND OF THE INVENTION

The instant invention relates to a cassette for storing paper sheets to be fed seriatim therefrom, and more particularly to such a cassette capable of storing paper sheets of two different lengths therein.

The transfer paper for transfer type copying devices, and the photosensitive paper used in electrofax systems, as well as the printing paper used in simple printers are considered as cut sheets. It is common practice to automatically feed such sheets by positioning them in a cassette and then loading the cassette into the unit. Some of the prior art cassettes include free floating corner separators which exert a downward pressure on the stack of sheets being fed equal only to their own weight, and a bottom plate which can be spring biased upwardly against a feed roller so that the top sheet of the stack of sheets is always fed from the same height. An example of the foregoing type of cassette can be found in U.S. Pat. No. 3,919,972, issued Nov. 18, 1975.

With prior art cassettes, whenever it is desired to provide a machine such as a photocopier with more than one size paper, a number of cassettes corresponding to the number of different sized sheets employed must be used. The instant invention overcomes this problem by providing a cassette which includes the latest advance of free floating corner separators and an upwardly biased bottom plate and which can accommodate two different lengths of paper. The obvious advantage of the instant invention is that when a machine operator desires to change the size of the paper, it is only necessary to remove the cassette, turn it upside down, and re-insert the cassette in the machine.

SUMMARY OF THE INVENTION

The instant invention provides a paper cassette for storing two different lengths of paper sheets. The cassette comprises a rear panel, a pair of side panels extending forward from the rear panel, a front panel operatively connected to the pair of side panels, a bottom panel extending between the bottom of the side panels from the bottom of the rear panel about three quarters of the distance toward the bottom of the front panel, and a top panel extending between the top of the side panels from the top of the rear panel about three quarters of the distance toward the top of the front panel. Additionally, the cassette comprises a first pair of free floating corner separators situated at the top of the corners defined by the front and side panels, a second pair of free floating corner separators situated at the bottom of the corners defined by the front and side panels, a flexible separator panel extending from the rear panel substantially the entire length of the cassette but spaced from said front panel and substantially bifurcating the cassette into a top portion and a bottom portion, the top portion accommodating the shorter length paper and the bottom portion accommodating the longer length paper, and a partition extending between the side panels across the top portion of the cassette, the partition being situated a fixed distance from the rear panel to accommodate the shorter length paper.

DETAILED DESCRIPTION

Figure 1:
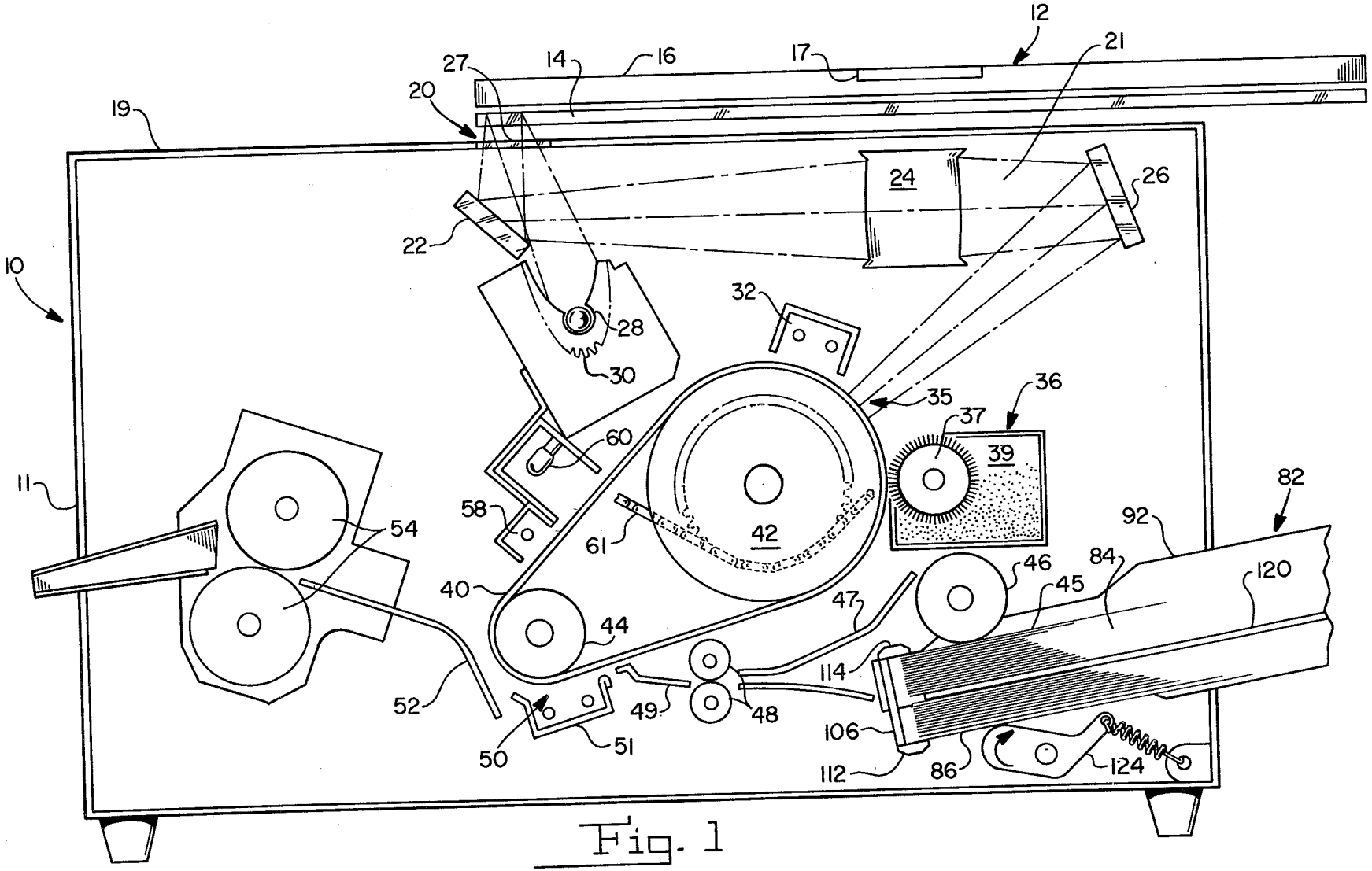
FIG. 1 is a schematic, side elevational view showing a paper cassette filled with paper according to the instant invention inserted in an electrophotocopying machine.

In describing the preferred embodiment of the instant invention, reference is made to the drawings, wherein there is seen in FIG. 1 a copier 10 which has a rectangular reciprocating carrier 12 movably mounted on top of a cabinet 11. The carriage 12 includes a transparent platen 14 on which documents are placed face down for copying. Overlying the platen 14 is an opaque, movable cover 16 which has a white surface juxtaposed to the platen 14. The cover 16 is connected by a hinge to one of the longer sides of the carriage 12. The cover 16 has a handle 17 disposed opposite to the hinged side of the cover 16. An operator can manipulate the handle 17 in order to raise and lower the cover 16 and thereby place on or remove documents from the platen 14.

The carriage 12 is shown in FIG. 1 in its extreme right or home position. During a copy cycle, the carriage 12 moves to the left a predetermined distance that is long enough to enable the copier 10 to make copies of fourteen inch long documents. Underneath the carriage 12 is an illuminating station, generally indicated at 20, which includes a relatively narrow, transparent window 27 that is mounted on the upper surface 19 of the cabinet 11. The window 27 extends across the width of the upper surface 19. A light source is operatively displaced underneath the window 27 and comprises a lamp 28 axially aligned and partially surrounded by a shaped reflector 30 which serves to direct the light from the lamp 28 toward the window 27. As the carriage 12 moves from right to left, a document on the carriage passes over illumination window 27 and is illuminated by the light from the lamp 28. In other words, the document is scan exposed across the illuminating station 20.

An image of the document is transmitted to the photoreceptor belt 40 at an imaging station generally designated 35. The image is transmitted along a Z-shaped path by optical system 21 comprising tilted mirrors 22 and 26 and a lens 24. Mirror 22 receives an image of the illuminated document as the latter passes over the window 27 and reflects the image toward converging lens 24. The lens 24 is focused upon a second tilted mirror 26 which in turn reflects the focused image onto a portion of the photoreceptor belt 40 at the imaging station 35. The photoreceptor belt 40 is moved through the imaging station at a predetermined speed in synchronism with the movement of the carriage 12 across the illuminating station 20. A drive roller 42 for the photoreceptor belt 40 is powered by a drive chain 61 (partially shown), which also drives other elements including the magnetic brush 37, the carriage 12, and the feed and queuing roller 46 and 48 respectively.

The photoreceptor belt 40 is supported by the relatively large diameter drive roller 42 and a relatively small diameter idler roller 44 which are diagonally displaced from each other. The belt 40 itself comprises an upper photosensitive layer, such as zinc oxide, that is coated on a conductive substrate such as a metalized polyester film.

Disposed around the periphery of the photoreceptor belt 40 are a number of the operating components of the copier 10. In particular, a two-wire corona charging unit 32 is juxtaposed to the photoreceptor belt 40 at approximately a one o'clock position with respect to the drive roller 42. The charging unit 32 is operable to impart a uniform electrostatic charge to the zinc oxide surface of the photoreceptor 40. The drive roller 42 turns in a clockwise direction, so that the uniformly charged surface of the photoreceptor belt 40 moves from the charging unit 32 toward the imaging station 35. In accordance with the well-known photocopying technique, the light-struck areas of the photoreceptor belt 40 are electrically discharged, thereby leaving a latent (undeveloped) electrostatic image that corresponds to the indicia areas (printed portions) of the document that is to be copied.

As drive roller 42 turns, the latent image on the photoreceptor belt 40 is carried past a developer station 36 disposed at a three o'clock position with respect to the drive roller 42. The developer station 35 includes a hopper 39 for holding a supply of toner particles. A rotating magnetic brush 37 picks up the toner particles from the hopper 39 and carries them into contact with the photoreceptor belt 40. The charged or latent image areas of the photoreceptor electrostatically attract and hold the toner particles, thus developing the latent image.

The toned or developed image leaves the developer station 36 and moves toward the transfer station 50 where there is a two-wire corona transfer charging apparatus 51. In timed relationship with the arrival of the toner image at the transfer corona 51, a copy sheet 45 also arrives at the transfer station 50. The copy sheet 45 is fed from a supply of copy sheets 84 stored in a removable cassette 82, to be discussed in further detail hereinbelow. The feed roller 46 feeds the uppermost copy sheet from the supply of copy sheets 84 through a paper guide 47 and into the nip of the queuing rollers 48. At a predetermined time in the course of a copy cycle, the queuing rollers 48 are actuated to feed the copy sheet 45 along a second paper guide 49 and into contact with the developed image carried on the photoreceptor belt 40. By virtue of the electric charge that is generated by the transfer corona 51, toner particles are attracted from the photoreceptor belt 40 toward the copy sheet 45 to which they loosely adhere.

The copy sheet 45 is separated from the photoreceptor belt 40 by the interaction of the small diameter idler roller 44 with the relative stiffness of the copy sheet 45. The copy sheet 45 is ultimately guided by a third paper guide 52 into the nip of pressure fixing rollers 54.

After the developed image is transferred, a residual latent electrostatic image and some untransferred toner remain on the photoreceptor belt 40. As the belt 40 continues along its path, it is carried past a single wire discharge corona 58 which neutralizes any charge on the untransferred toner. Next, the belt 40 passes underneath an array of incandescent erase lamps 60. Light from the erase lamps 60 illuminates the belt 40, discharges the residual latent image areas of belt 40 and thereby erases any remaining residual electrostatic image.

As the photoreceptor belt 40 begins its second cycle, the carriage 12 starts to return from its extreme left position toward its extreme right of home position. During the second cycle, the corona charge 32 and the transfer corona 51 are de-actuated. By virtue of the effects of the erase lamps 60 and discharge corona 58, the untransferred toner is now only loosely adhering to the photoreceptor belt 40. As the untransferred toner passes the magnetic brush 37, the latter attracts the untransferred toner from the belt 40 onto the magnetic brush 37. Hence, after the second cycle, the photoreceptor belt 40 is cleaned of toner and ready to make another copy.

Figure 2:
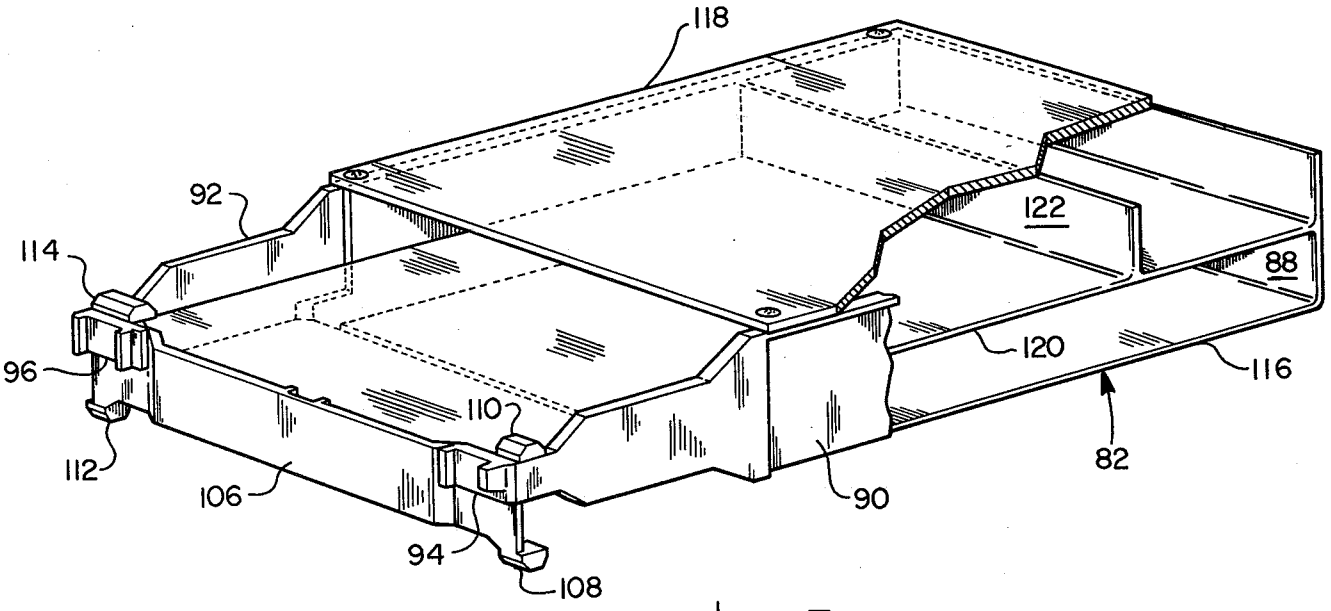
FIG. 2 is a perspective view of the empty paper cassette shown in FIG. 1.
Figure 5:
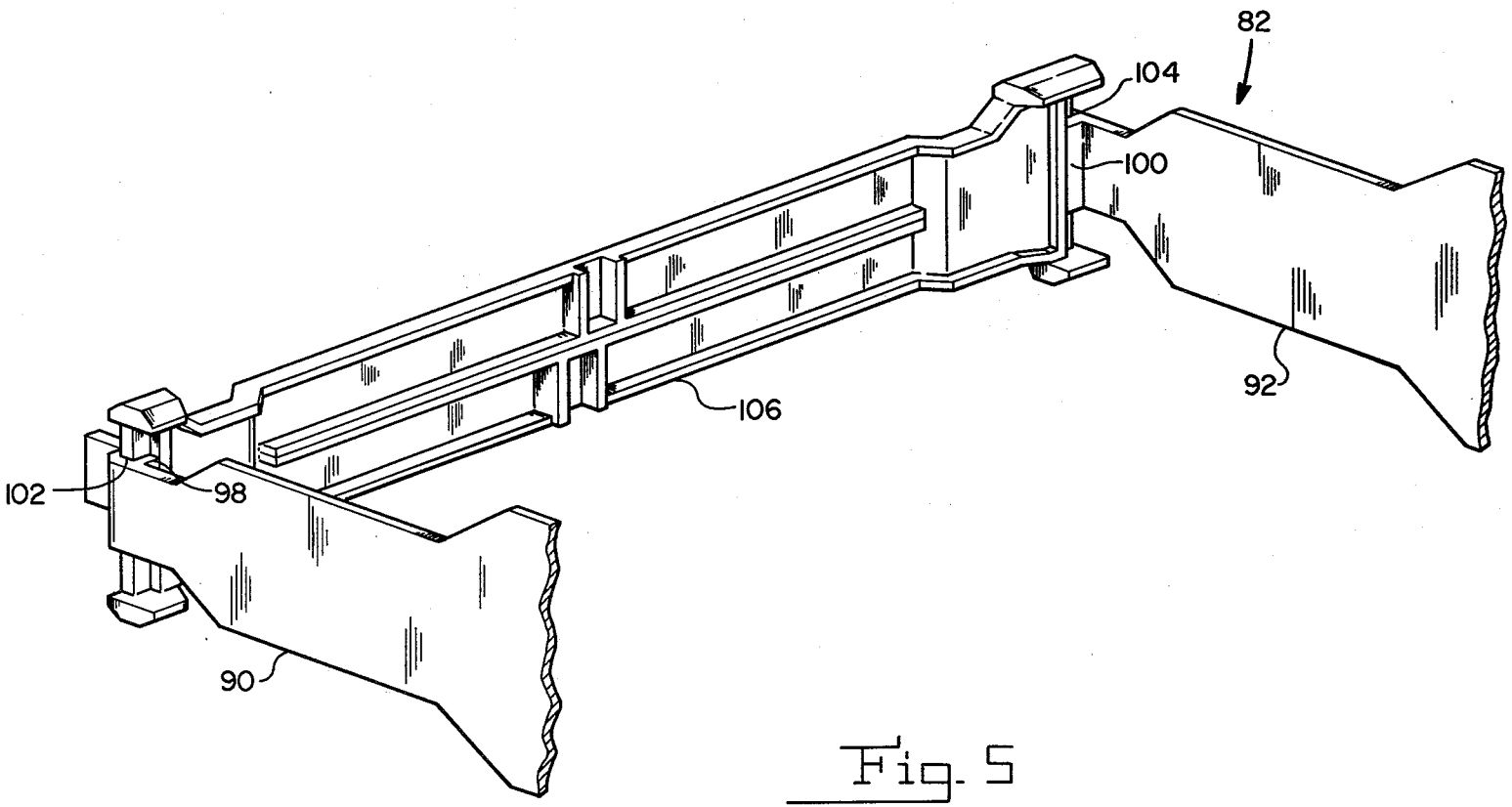
FIG. 5 is an enlarged, perspective view of the front and side panels of the filled cassette shown in FIG. 1.

For a more detailed discussion of the removable cassette 82, reference is made to FIG. 2, where there is seen a cassette 82 capable of storing two different lengths of paper sheets, i.e. a stack of shorter sheets 84 and a stack of longer sheets 86. The cassette 82 comprises a rear panel 88 and a pair of side panels 90 and 92 extending forward from the rear panel 88. Each of the side panels 90 and 92 includes 90 degree extensions 94 and 96 which together with their associated ridges 98 and 100 (see FIG. 5) define channels 102 and 104. A front panel 106 slidingly engages the channels 102 and 104. Four corner separators 108, 110, 112 and 114 extend from the four corners of the front panel 106 and secure the front panel 106 to the side panels 90 and 92 by limiting the extent of their sliding movement. The corner separators also serve to buckle the copy sheet 45 being fed, as explained in more detail hereinbelow. Since the corner separators are integral with the front panel 106, and the front panel 106 is free to float vertically, it can be seen the corner separators are also free floating vertically and exert a force against the top copy sheet 45 being fed equivalent only to the weight of the front panel 106.

A bottom panel 116 extends between the bottom of the side panels 90 and 92 from the bottom of the rear panel 88 about three quarters of the distance toward the bottom of the front panel 106. A top panel 118 similarly extends between the top of the side panels 90 and 92 from the top of the rear panel 88 about three quarters of the distance toward the top of the front panel 106.

A flexible separator panel 120 extends from the rear panel 88 substantially the entire length of the cassette 82. However, the separator panel 120 is spaced from the front panel 106. The separator panel 120 is so situated as to substantially bifurcate the cassette 82 into a top portion for housing the stack of shorter sheets 84 and a bottom portion for housing the stack of longer sheets 86.

A partition 122 extends between the side panels 90 and 92 across the top portion of the cassette 82. The partition 122 is situated a fixed distance from the rear panel 88 in order to accommodate the stack of shorter sheets 84.

Figure 3:
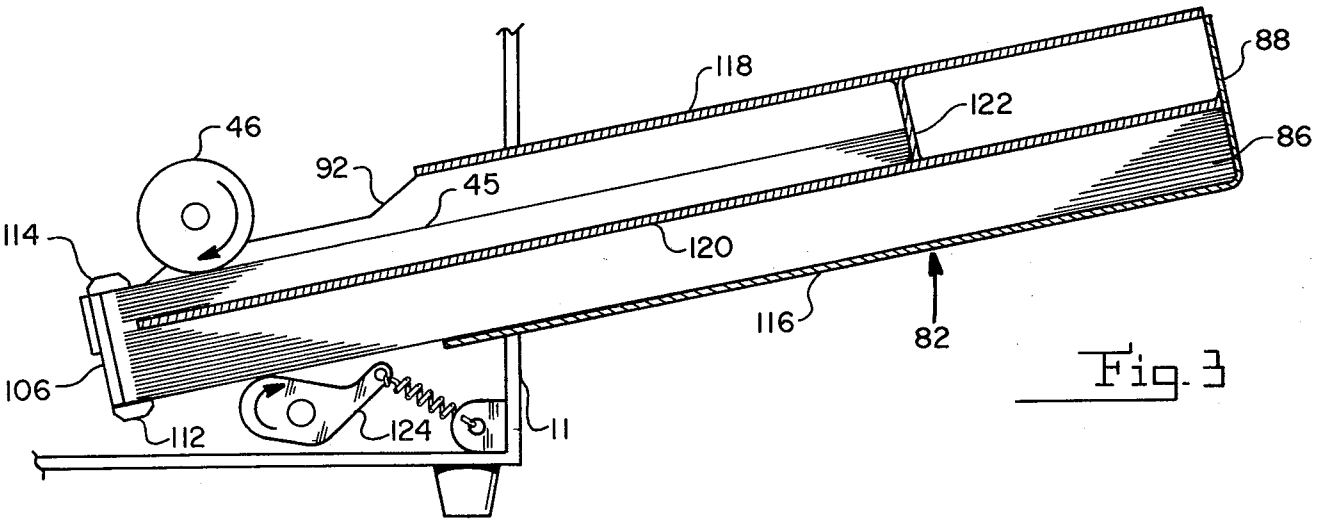
FIG. 3 is an enlarged, vertical sectional view of the filled cassette shown in FIG. 1.

As best seen in FIG. 3, when the cassette 82 is inserted in the copier 10, the uppermost copy sheet 45 is biased upwardly into engagement with the feed roller 46 by a spring biased cam 124. The cam 124 urges the stack of longer sheets 86 upward against the separator panel 120 which in turn urges the stack of shorter sheets 84 against the feed roller 46. The free floating corner separators 110 and 114 rest on the stack of shorter sheets 84 with a force equal only to the weight of the front panel 106. When a copy sheet is called for, the feed roller 46 rotates and engages the uppermost sheet 45 to move it forward against the top corner separators 110 and 114, which buckle the copy sheet 45. Further rotation of the feed roller 46 causes the front edge of the copy sheet 45 to jump over the corner separators 110 and 114, thereby assuring that only one sheet at a time will be fed from the stack of shorter sheets 84.

Figure 4:
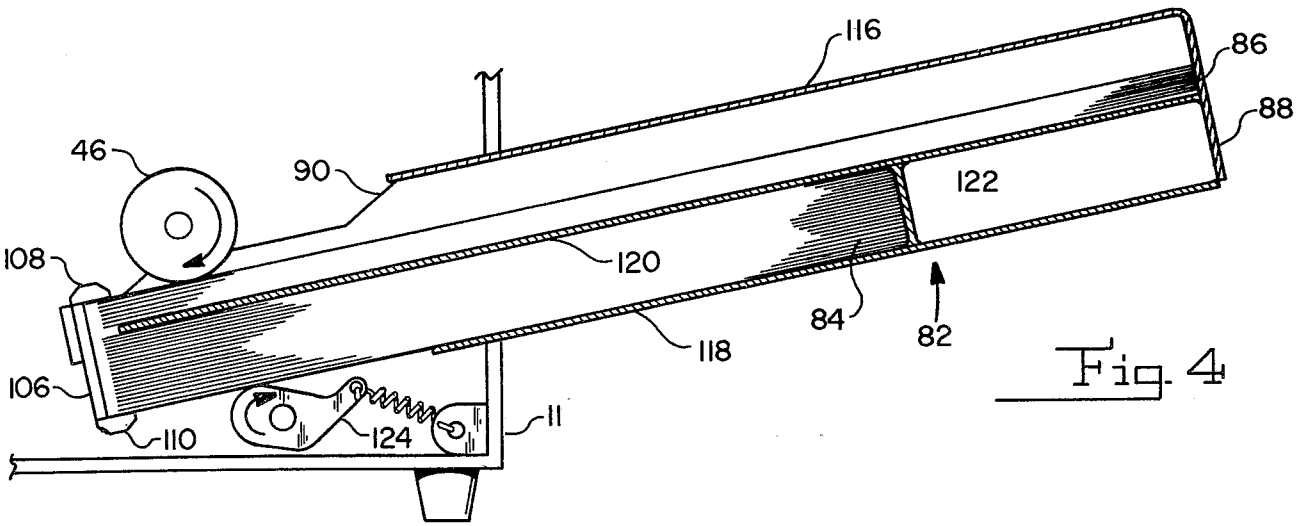
FIG. 4 is the same as FIG. 3 but the cassette is turned upside down.

When it is desired to use the longer sheets 86 in the copier 10, it is only necessary for the operator to withdraw the cassette 82 from the copier 10, turn the cassette 82 upside down, and re-insert the cassette 82 into the copier as shown in FIG. 4. In the upside down mode, everything discussed above with respect to the mode of FIG. 3 is reversed, so that the bottom separators 108 and 112 rest on the top copy sheet and function as corner separators.

The panels described above are preferably formed from a plastic, and the plastic may be transparent or translucent or opaque as desired.

While this invention has been described with reference to the structure disclosed herein, it is not confined to the details set forth, and this application is intended to cover such modifications or changes as may come within the purposes of the improvements of the scope of the following claims.

What is claimed is:

1. A paper cassette for storing two different lengths of paper sheets, comprising:

a rear panel;

a pair of side panels extending forward from said rear panel;

a front panel operatively connected to said pair of side panels;

a bottom panel extending between the bottom of the side panels from the bottom of the rear panel about three quarters of the distance toward the bottom of the front panel;

a top panel extending between the top of the side panels from the top of the rear panel about three quarter of the distance toward the top of the front panel;

a first pair of free floating corner separators situated at the top of the corners defined by the front and side panels;

a second pair of free floating corner separators situated at the bottom of the corners defined by the front and side panels;

a flexible separator panel extending from the rear panel substantially the entire length of the cassette but spaced from said front panel and substantially bifurcating the cassette into a top portion and a bottom portion, said top portion accommodating the shorter length paper and said bottom portion accommodating the longer length paper; and a partition extending between the side panels across the top portion of the cassette, said partition being situated a fixed distance from the rear panel to accommodate the shorter length paper.

2. The cassette of claim 1, wherein each of the side panels includes a 90 degree extension and an associated ridge defining a channel at their forward end for slidingly receiving the front panel.

3. In combination, an electrophotocopying machine and a paper cassette for storing two different lengths of paper sheets reversibly insertable in said electrophotocopying machine, said cassette comprising:

a rear panel;

a pair of side panels extending forward from said rear panel;

a front panel operatively connected to said pair of side panels;

a bottom panel extending between the bottom of the side panels from the bottom of the rear panel about three quarters of the distance toward the bottom of the front panel;

a top panel extending between the top of the side panels from the top of the rear panel about three quarter of the distance toward the top of the front panel;

a first pair of free floating corner separators situated at the top of the corners defined by the front and side panels;

a second pair of free floating corner separators situated at the bottom of the corners defined by the front and side panels;

a flexible separator panel extending from the rear panel substantially the entire length of the cassette but spaced from said front panel and substantially bifurcating the cassette into a top portion and a bottom portion, said top portion accommodating the shorter length paper and said bottom portion accommodating the longer length paper; and a partition extending between the side panels across the top portion of the cassette, said partition being situated a fixed distance from the rear panel to accommodate the shorter length paper, whereby said cassette may be inserted with either the top portion or the bottom portion on top in suitable position for feeding into the electrophotocopying machine.

4. The combination of claim 3, wherein each of the side panels includes a 90 degree extension and an associated ridge defining a channel at their forward end for slidingly receiving the front panel.

* * * * *